US006797176B1

(12) United States Patent
Ohkawa

(10) Patent No.: US 6,797,176 B1
(45) Date of Patent: Sep. 28, 2004

(54) PLASMA MASS FILTER WITH INDUCTIVE ROTATIONAL DRIVE

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 10/613,833

(22) Filed: Jul. 3, 2003

(51) Int. Cl.[7] ..... B03C 1/00

(52) U.S. Cl. ..... 210/695; 210/748; 210/222; 210/243; 209/12.1; 209/227; 209/722; 96/2; 96/3; 95/28

(58) Field of Search ..... 210/695, 748, 210/222, 243; 209/12.1, 227, 722; 96/2, 3; 95/28

(56) References Cited

U.S. PATENT DOCUMENTS 3,722,677 A 3/1973 Lehnert
5,039,312 A 8/1991 Hollis, Jr. et al.
5,653,854 A 8/1997 Miyamoto et al.
6,096,220 A 8/2000 Ohkawa
6,258,216 B1 7/2001 Ohkawa
6,287,463 B1 * 9/2001 Ohkawa ..... 210/222

* cited by examiner

*Primary Examiner*—David A. Reifsnyder
(74) *Attorney, Agent, or Firm*—Nydegger & Associates

(57) ABSTRACT

A device for separating high mass to charge particles ($M_1$) from low mass to charge particles ($M_2$) in a plasma includes a cylindrical wall that surrounds a chamber and defines an axis. Rectangular shaped coils are mounted on the wall to establish a magnetic field, $B_0$, in the chamber that is aligned substantially perpendicular to the axis and which rotates about the axis. Circularly shaped coils are provided to generate a time-constant, axially aligned magnetic field, $B_z$, in the chamber. Passive, ring-shaped electrodes are positioned at the ends of the wall and connected to resistors which are then grounded. The rotating magnetic field, $B_0$, rotates the plasma in the axially aligned magnetic field, $B_z$, which in turn, induces a radially oriented electric field, $E_r$, in the chamber. The crossed fields (i.e. $E_r \times B_z$) cause the particles, $M_1$, to strike the wall while the particles, $M_2$, transit through the chamber.

20 Claims, 1 Drawing Sheet

PLASMA MASS FILTER WITH INDUCTIVE ROTATIONAL DRIVE

FIELD OF THE INVENTION

The present invention pertains generally to devices and methods for separating the constituents of a multi-constituent material. More particularly, the present invention pertains to devices for efficiently rotating a plasma that is created from a multi-constituent material to separate particles in the plasma according to their respective mass to charge ratios. The present invention is particularly, but not exclusively, useful as a filter to separate high mass particles from low mass particles in a plasma that is rotated using a rotating magnetic field.

BACKGROUND OF THE INVENTION

There are many applications in which it is desirable to separate the constituents of a multi-constituent material. One such application is the treatment of waste that is hazardous due to the presence of one or more highly radioactive materials. For example, it is well known that only a small percentage of the entire volume of waste from a commercial nuclear reactor consists of radionuclides that cause the waste to be hazardous. Thus, if these radionuclides can somehow be segregated from the other constituents of the nuclear waste, the handling and disposal of the relatively small volume of hazardous components can be greatly simplified and the overall cost of nuclear waste disposal can be significantly reduced.

One separation technique that has previously been suggested takes advantage of the fact that the orbital motions of charged particles (ions) in crossed electric and magnetic fields, will differ from each other according to their respective mass to charge ratio. Thus, when the probability of ion collision is significantly reduced, the possibility for improved separation of the particles due to their orbital mechanics is Increased. For example, U.S. Pat. No. 6,096,220, which issued on Aug. 1, 2000 to Ohkawa, for an invention entitled "Plasma Mass Filter" and which is assigned to the same assignee as the present invention, discloses a device which relies on the different, predictable, orbital motions of charged particles in crossed electric and magnetic fields In a chamber to separate the charged particles from each other. In the filter disclosed in Ohkawa '220, the magnetic field is oriented substantially axially, and an electric field is applied that is oriented substantially radially and outwardly from the axis, with both the magnetic field and the electric field being substantially uniform both azimuthally and axially.

As further disclosed in Ohkawa '220, this configuration of applied electric and magnetic fields causes ions having relatively low mass to charge ratios to be confined inside the chamber during their transit of the chamber. On the other hand, ions having relatively high mass to charge ratios are not so confined. Instead, these larger mass ions are collected at the wall of the chamber before completing their transit through the chamber. The demarcation between high mass particles and low mass particles is a cut-off mass, $M_c$, which is established by setting the magnitude of the magnetic field strength, B, the positive voltage along the longitudinal axis, $V_{ctr}$, and the radius of the cylindrical chamber, "a". The cut-off mass, $M_c$, can then be determined with the expression:

$$M_c=ea^2(B)^2/8V_{ctr}$$

One important performance metric for a separation device such as the one disclosed in Ohkawa '220 is the amount of energy that is required to obtain a desired level of separation. In greater detail, energy must be expended to convert the multi-constituent material into a plasma, including energy to vaporize, ionize and heat the multi-constituent material, and in addition, energy must be expended to rotate the ions in the plasma. In the device disclosed in Ohkawa '220, plasma rotation is driven by a radial current that is established in the uniform axial magnetic field (i.e. the configuration is similar to a homopolar motor). Thus, the plasma rotates in response to applied electric and magnetic fields ($j_r \times B_z$). More specifically, the applied electric field is generated using energized, direct-current (DC) electrodes that are placed in contact with the plasma. The drawbacks associated with these active DC electrodes are two-fold. The first drawback, as implied above, involves energy considerations. Specifically, it would be desirable if a more energy efficient mechanism was available to rotate the plasma. In addition, the use of active DC electrodes that are in contact with the plasma can result in undesirable DC arcing.

The present invention contemplates a plasma rotation that is driven inductively by a rotating magnetic field similar to the field used to rotate the rotor of an induction motor. An additional uniform axial magnetic field is applied, the effect of which is two-fold. First, in the applied axial magnetic field, the rotating plasma acts as a homopolar generator driven by an induction motor. The result is an induced electric field that is oriented radially. In addition, the applied axial magnetic field interacts with the induced radial electric field to separate relatively high mass ions from relatively low mass ions in a manner similar to the device disclosed in Ohkawa '220.

The characteristics of a system in which plasma rotation is driven Inductively can be estimated by considering a simplified model in which the plasma is replaced by a conductive cylinder. For the model, the conductive cylinder is supported by an axle and multiple concentric slip rings are positioned at both ends of the cylinder and electrically connected to the cylinder. The cylinder is further disposed within a coil system that produces a rotating magnetic field represented by the vector potential $A_z \propto \exp[i/\theta - i\omega t]$.

The field components are given by:

$$B_r=[il/r]A_z \quad [1a]$$

$$B_\theta=\partial A_z/\partial r \quad [1b]$$

$$E_z=i\theta A_z \quad [1c]$$

Using Ohm's law, the expression:

$$E_z-\omega_0 rB_r=\sigma^{-1}j_z \quad [2]$$

can be obtained, where $\omega_0$ is the angular frequency of the cylinder rotation and $\sigma$ is the electrical conductivity of the cylinder.

The combination of Maxwell's equations and Ohm's law yields:

$$\{r^{-1}\partial/\partial r[r\partial/\partial r]-r^2/r^2+i\mu_0\sigma[\omega-l\omega_0]\}A_z=0 \quad [3]$$

The solution of equation [3] is given by:

$$A_z=AJ_l[kr]\exp[i/\theta-i\omega t] \quad [4]$$

where $$k^2=i\mu_0\sigma\omega' \quad [5a]$$

$$\omega'=\omega-l\omega_0 \quad [5b]$$

Thus, the skin depth $k^{-1}$ depends on the relative rotational frequency between the cylinder and the field. The time averaged force per unit volume, F, is given by:

$$F_\theta=[\tfrac{1}{2}]j_z{}^*B_r=[\sigma\omega' l/2r]A^*AJ_r[k^*r]J_r[kr] \quad [6]$$

In terms of the magnetic field strength, equation [6] becomes:

$$F_\theta=[\mu_0\sigma\omega' rl/]][B_r{}^*B_r/2\mu_0] \quad [7a]$$

Thus, the force has the characteristics of an induction motor in that the force is small at $\omega_0$~0 (because the field does not penetrate) and also the force is small when $\omega'$~0.

Continuing with the model, the current flows in the axial direction in the conductive cylinder and in the azimuthal direction in the slip rings. The contact resistance between the cylinder and the slip rings is present in the electrical circuit and therefore should be included in the conductivity of the above formula. When the cylinder is replaced with a plasma, the contact resistance is replaced by the resistance across the sheath and the equivalent conductivity $\sigma^*$ is given by:

$$\sigma^*=\sigma\{1+[\sigma k_B T_e/e^2 n v_s L]\}^{-1} \quad [8]$$

where $env_s$ is the ion saturation current and L is the half length of the plasma. At low densities (i.e. $n<10^{19}$ $m^{-3}$) the sheath resistance dominates.

During steady state rotation, the inductive drive balances the friction of the rotating conductive cylinder. In the rotating plasma, the loss of the rotating ions at the ends represents the frictional loss. For the device disclosed in Ohkawa '220, the frictional loss is balanced by the homopolar drive, $j_r B_z$, given by:

$$j_r B_z=nMv_s\omega_0 r/L \quad [9]$$

where M is the ion mass. If the inductive drive (given by eq [6]) is to have the same radial distribution as the homopolar drive (given by eq [9]), the azimuthal mode number l should be unity for kr<<1 and uniform density. By putting l=1 and equating eq [7] and eq [9] the following expression can be obtained:

$$\sigma^*\omega'|B_r|^2/2=nMv_s\omega_0/L \quad [10]$$

It is noted that $B_r$ is approximately uniform. At low densities $\sigma^*<<\sigma$ the following expression can be obtained:

$$|B_r|^2=[2Mk_B T_e/e^2 L^2][\omega_0/\omega'] \quad [11]$$

Thus, the required field strength is independent of the plasma density. Accordingly, the power required to inductively drive the rotation is approximately equal to the active electrode DC supply power for the device disclosed by Ohkawa '220 operating at a field of about $10^{-3}$ T.

In light of the above, it is an object of the present invention to provide devices and methods suitable for the purposes of separating the constituents of a multi-constituent material. It is another object of the present invention to provide devices and methods for efficiently rotating a plasma that is created from a multi-constituent material to separate particles in the plasma according to their respective mass to charge ratios. It is yet another object of the present invention to provide devices and methods for efficiently rotating a plasma and separating the plasma in crossed electric and magnetic fields without using active electrodes that can create undesirable DC arcing. Yet another object of the present invention is to provide devices and methods for rotating a plasma to separate particles in the plasma according to their respective mass to charge ratios which are easy to use, relatively simple to implement, and comparatively cost effective.

SUMMARY OF THE INVENTION

The present invention is directed to devices and methods for separating the constituents of a multi-constituent material. In overview, the multi-constituent material is first converted into a multi-species plasma having particles with relatively high mass to charge ratios ($M_1$) and particles with relatively low mass to charge ratios ($M_2$). The multi-species plasma is then rotated using a rotating magnetic field. During plasma rotation, an induced radially oriented electric field combines with an applied axially aligned magnetic field to separate the high mass particles ($M_1$) from the low mass particles ($M_2$).

In greater structural detail, the separating device typically includes an elongated, cylindrical shaped wall that extends from a first open end to a second open end, surrounds a chamber therebetween, and defines a longitudinal axis. The device further includes a plurality of substantially rectangular shaped coils that are mounted on the outside of the wall to establish a magnetic field throughout the chamber. Each rectangular shaped coil has a pair of opposed sides that are substantially straight and oriented substantially longitudinally when the coil is mounted on the wall. In addition, each rectangular shaped coil has a pair of opposed sides that are curved to conform to the radial contour of the cylindrical wall. As a consequence, these curved sides are oriented substantially azimuthally relative to the longitudinal axis when the coil is mounted on the wall.

A source of multi-phase, alternating current is provided to energize the rectangular shaped coils and produce the magnetic field in the chamber. For instance, in one embodiment, four rectangular shaped coils are uniformly distributed around the circumference of the wall, with each coil extending substantially from the first end to the second end of the wall. In this embodiment, each coil receives an alternating current having an angular frequency, $\omega$, from the multi-phase source with the current phase in each rectangular shaped coil being shifted by approximately-ninety degrees (90°) from coil to coil around the cylinder. With this cooperation of structure, a magnetic field, $B_0$, Is established in the chamber that is aligned substantially perpendicular to the axis and which rotates about the axis due to the phasing of the current in the rectangular shaped coils.

The device further includes one or more coils, which are typically circularly shaped. When energized, these circularly shaped coils produce an axially aligned magnetic field, $B_z$, in the chamber that is constant in time. Also for the present invention, the device includes a first plurality of ring-shaped electrodes that are concentrically arranged about the longitudinal axis and attached to the first end of the wall. A second plurality of concentrically arranged, ring-shaped electrodes is attached to the second end of the wall. Each electrode is connected to an electrical ground through a relatively large resistor.

In operation, the rotating magnetic field, $B_0$, causes currents within the plasma to flow longitudinally and enter the passive electrodes where the currents then flow azimuthally. From the electrodes, the current flows through the resistors and then to ground. The lorentz force due to the longitudinally oriented currents and the magnetic field, $B_0$, accelerates the plasma in the azimuthal direction. In the presence of the axially aligned magnetic field, $B_z$, the rotating plasma induces a radially oriented electric field, $E_r$, in the chamber.

The relatively large resistors allow the electric field, $E_r$, to 'charge up' in the chamber.

In the crossed electric and magnetic fields (i.e. $E_r \times B_z$), ions in the plasma having a relatively low mass to charge ratio ($M_2$) are placed on relatively small radius orbital trajectories and transit through the chamber exiting at one of the chamber ends. On the other hand, ions in the plasma having a relatively high mass to charge ratio ($M_1$) are not so confined. Instead, these larger mass ions are placed on relatively large radius trajectories and strike the cylindrical wall where they are captured. Specifically, for a cylindrical wall having an inside radius "a" from the longitudinal axis, ions having a mass ($M_1$) that is greater than a cut-off mass, $M_c(M_1>M_c)$ will be collected at the wall, where $$M_c=eB_z/4\omega$$

wherein "e" is the ion charge.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
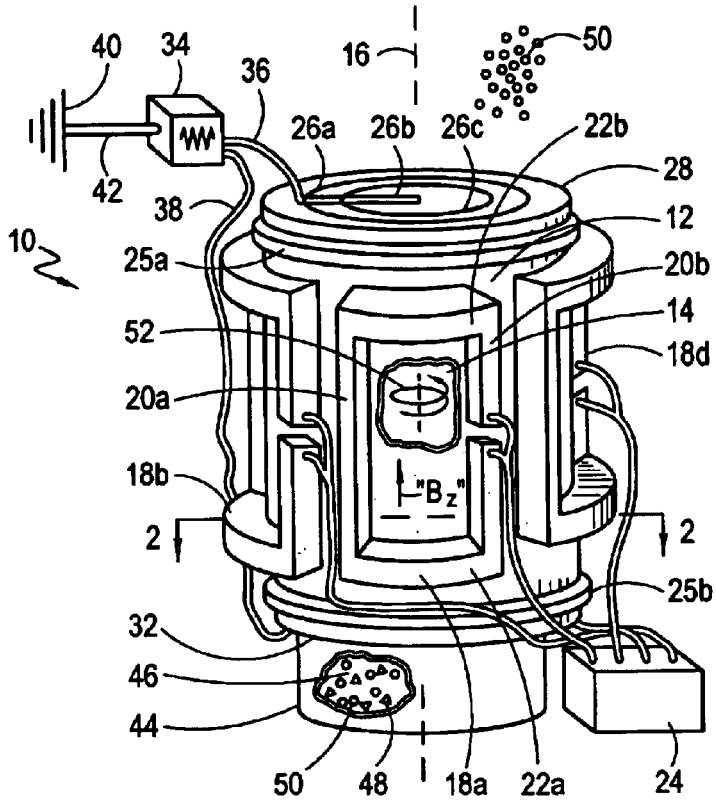
FIG. 1 is a simplified, perspective view of a plasma mass filter having an inductive rotational drive with portions of the filter broken away for clarity.

Referring initially to FIG. 1, a plasma mass filter is shown and generally designated 10. As shown, the filter 10 includes a substantially cylindrical shaped wall 12 which surrounds a chamber 14, and defines a longitudinal axis 16. The actual dimensions of the chamber 14 are somewhat, but not entirely, a matter of design choice. However, the radial distance "a" (shown in FIG. 2) between the longitudinal axis 16 and the wall 12 is a parameter which will affect the operation of the filter 10, and as indicated elsewhere herein, must be taken into account.

Figure 2:
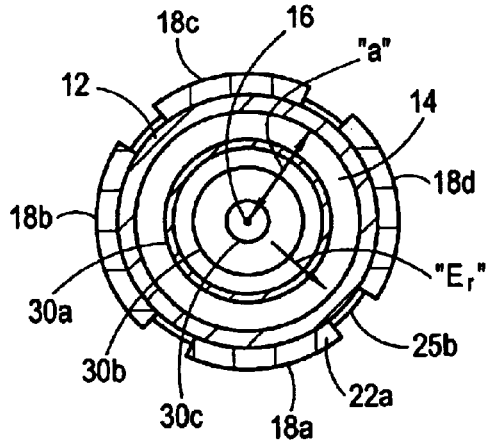
FIG. 2 is a cross-sectional view of the plasma mass filter shown in FIG. 1 as seen along line 2—2 in FIG. 1.

With cross-reference now to FIGS. 1 and 2, it can be seen that the filter 10 further includes four substantially rectangular shaped coils 18*a–d* that are mounted on the outside of the wall 12 to establish a magnetic field throughout the chamber 14. As further shown for the filter 10, each rectangular shaped coil 18*a–d* has a pair of opposed sides 20*a,b* that are substantially straight and oriented substantially longitudinally when the coils 18*a–d* are mounted on the wall 12. In addition, each rectangular shaped coil 18*a–d* has a pair of opposed sides 22*a,b* that are curved to conform to the radial contour of the cylindrical wall 12. As a consequence, the curved sides 22*a,b* are oriented substantially azimuthally relative to the longitudinal axis 16 when the coils 18*a–d* are mounted on the wall 12.

Figure 3:
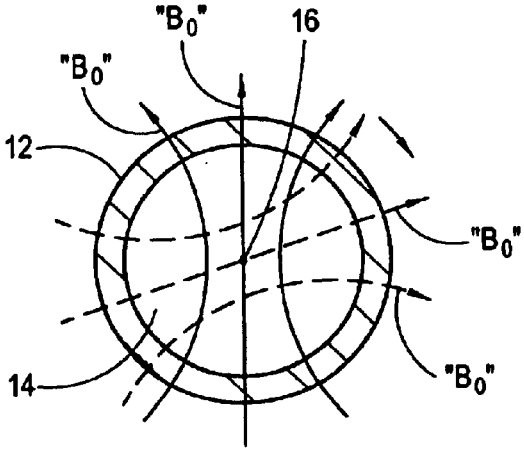
FIG. 3 is a cross-sectional view of the plasma mass filter as in FIG. 2 showing the rotating magnetic field (note: electrodes and coils are not shown in FIG. 3 for clarity).

FIG. 1 further shows that the filter 10 includes a source 24 of multi-phase, alternating current having an angular frequency, ω, to energize each coil 18*a–d* and produce a magnetic field in the chamber 14. Typically, each coil 18*a–d* receives an alternating current from the multi-phase source 24 having a current phase that is shifted by approximately ninety degrees (90°) from coil 18*a–d* to coil 18*a–d* around the cylindrical wall 12. In greater detail, the current phase in coil 18*b* is shifted by approximately ninety degrees relative to coil 18*a*. Also, the current phase in coil 18*c* is shifted by approximately ninety degrees relative to coil 18*b* and by approximately one-hundred-eighty degrees relative to coil 18*a*. Furthermore, the current phase in coil 18*d* is shifted by approximately ninety degrees relative to coil 18*c* and by approximately two-hundred-seventy degrees relative to coil 18*a*. With this cooperation of structure, a magnetic field, $B_0$ is established in the chamber 14 that is aligned substantially perpendicular to the axis 16 and which rotates about the axis 16, as shown in FIG. 3. More specifically, FIG. 3 shows the magnetic field $B_0$, in a first orientation (represented by three solid field lines) and after a rotation about the axis 16 to a second orientation (represented by three dotted field lines).

As shown in FIG. 1, the filter 10 includes circularly shaped coils 25*a,b* which are mounted on the outer surface of the wall 12 to surround the chamber 14. In a manner well known in the pertinent art, the coils 25*a,b* can be activated to create a magnetic field in the chamber 14 which has a component, $B_z$ that is substantially constant in time and is directed substantially along the longitudinal axis 16.

Cross-referencing FIGS. 1 and 2, it can be seen that the filter 10 includes three ring-shaped electrodes 26*a–c* that are concentrically arranged about the longitudinal axis 16 and attached to the first end 28 of the wall 12. As best seen in FIG. 2, another set of three concentrically arranged, ring-shaped electrodes 30*a–c* is attached to the second end 32 of the wall 12. It is to be further appreciated from FIG. 1 that each electrode 26*a–c*, 30*a–c* is connected to a relatively large resistor in resistor bank 34 via wires 36, 38. From resistor bank 34, each resistor is connected to an electrical ground 40 via wire 42.

Continuing with FIG. 1, it can be seen that the filter 10 includes an injector 44 that is positioned at the end 32 of the wall 12. Functionally, the injector 44 first converts a multi-constituent material into a multi-species plasma 46 and injects the multi-species plasma 46 into the chamber 14. As shown in FIG. 1, the multi-species plasma 46 typically includes particles with relatively high mass to charge ratios, $M_1$, (hereinafter high mass particles 48) and particles with relatively low mass to charge ratios, $M_2$, (hereinafter low mass particles 50). For instance, an inductively coupled plasma (ICP) torch can be used, or any other injector known in the pertinent art capable of converting a multi-constituent material into a multi-species plasma 46 and injecting the multi-species plasma 46 into the chamber 14, can be used in the filter 10.

In operation, the rotating magnetic field, $B_0$ causes electrical currents, J, within the plasma to flow longitudinally through the chamber 14 and enter the passive electrodes 26*a–c*, 30*a–c* where the electrical currents then flow azimuthally. From the electrodes 26*a–c*, 30*a–c*, the current flows through resistors in the resistor bank 34 and then to ground 40. The lorentz force due to the longitudinally oriented currents, J, and the magnetic field, $B_0$ causes the plasma (including the high mass particles 48 and low mass particles 50) to rotate about the axis 16. In the presence of the axially aligned magnetic field, $B_z$, the rotating particles 48, 50 induce a radially oriented electric field, $E_r$, (see FIG. 2) in the chamber 14.

Under the influence of the crossed electric and magnetic fields (i.e. $E_r \times B_z$), charged particles 48, 50 in the plasma 46 will travel generally along helical paths around the longitudinal axis 16 similar to the path 52 shown in FIG. 1. Due to the configuration of the electric field, $E_r$, and magnetic field, $B_z$, the plasma mass filter 10 causes charged particles 48, 50 in the multi-species plasma 46 to behave differently as they travel in the chamber 14. Specifically, charged particles having masses above a cutoff mass, $M_c$, given by the equation:

$$M_c = eB_z/4\omega$$

are not able to transit the chamber 14 and, instead, they are ejected into the wall 12. In the above expression for the cutoff mass, $M_c$, the variables $B_z$ and $\omega$ can be specifically designed or established for the operation of plasma mass filter 10. Accordingly, charged high-mass particles 48 of mass $M_1$, where $M_1 > M_c$, will be placed on relatively large radius trajectories where they will strike and be captured by the wall 12 of the filter 10. On the other hand, charged low-mass particles 50 with mass $M_2$, where $M_2 < M_c$, will be placed on relatively large radius trajectories (i.e. orbits). These low-mass particles 50 are confined in the chamber 14 during their transit through the chamber 14. Consequently, the low-mass particles 50 exit the chamber 14 and are, thereby, effectively separated from the high-mass particles 50.

The relatively large resistors allow the electric field, $E_r$, to 'charge up' in the chamber 14 to a desired level to effect separation as described above. The electrodes 26*a–c*, 30*a–c* are grounded to drain current associated with the captured high mass ions 50.

While the particular inductive rotational drive as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A device for separating particles of relatively high mass/charge ratios ($M_1$) from particles of relatively low mass/charge ratios ($M_2$), said device comprising:

a cylinder having a first end and a second end with a wall extending therebetween to define a chamber with a longitudinal axis;

a means for generating an axially aligned magnetic field ($B_z$) in said chamber, a plurality of substantially rectangular shaped coils mounted on said wall of said cylinder with each coil having a pair of opposed sides oriented substantially longitudinally, and a pair of opposed sides oriented substantially azimuthally relative to the axis;

a means for sending alternating electrical currents through each said coil wherein the current in each said coil has a phase difference relative to the current in an adjacent said coil to generate a magnetic field ($B_0$) in said chamber that is aligned substantially perpendicular to the axis and rotates about the axis; and a means for introducing a multi-species plasma into said chamber for interaction with said rotating magnetic field ($B_0$) to rotate said plasma in said axially oriented magnetic field component ($B_z$) and induce a radially oriented electric field ($E_r$) in said chamber to separate particles $M_1$ from particles $M_2$ in the crossed electric and magnetic fields ($E_r \times B_1$).

2. A device as recited in claim 1 having four said coils with the alternating current in each said coil having a phase difference of ninety degrees (90°) relative to the alternating current in each adjacent said coil.

3. A device as recited in claim 1 further comprising a first plurality of electrodes at said first end and a second plurality of electrodes at said second end.

4. A device as recited in claim 3 further comprising a means for connecting said electrodes to ground with at least one resistor interconnected between said electrodes and ground to allow the electric field ($E_r$) to charge up.

5. A device as recited in claim 3 wherein said first plurality of electrodes include a plurality of passive ring electrodes concentrically mounted at said first end of said chamber and said second plurality of electrodes include a plurality of passive ring electrodes concentrically mounted at said second end of said chamber.

6. A device as recited in claim 1 wherein the plasma is introduced into said chamber through said first end thereof and said device further comprises a collector at said second end of said chamber for collecting the particles $M_2$.

7. A device as recited in claim 1 wherein the particles $M_1$ are collected on said wall of said cylinder.

8. A device for separating particles with relatively high mass to charge ratios ($M_1$) from particles with relatively low mass to charge ratios ($M_2$), said device comprising:

a means for rotating a magnetic field about an axis;

a means for introducing a multi-species plasma containing particles $M_1$ and particles $M_2$ into the rotating magnetic field to rotate the multi-species plasma; and a means for establishing a substantially axially aligned magnetic field for interaction with said rotating multi-species plasma to induce a radially oriented electric field and separate the particles $M_1$ from the particles $M_2$ in the axially aligned magnetic field and radially oriented electric field.

9. A device as recited in claim 8 further comprising a cylinder having a first end and a second end with a wall extending therebetween to define a chamber around the axis for holding the plasma during interaction of the plasma with the electric and magnetic fields.

10. A device as recited in claim 9 wherein said rotating means comprises a plurality of substantially rectangular shaped coils mounted on said wall of said cylinder with each coil having a pair of opposed sides oriented substantially longitudinally, and a pair of opposed sides oriented substantially azimuthally relative to the axis.

11. A device as recited in claim 10 wherein said rotating means further comprises a multi-phase alternating current source for sending electrical currents through said coils wherein the current in each said coil has a phase difference relative to the current in an adjacent said coil.

12. A device as recited in claim 11 having four said coils with the alternating current in each said coil having a phase difference of ninety degrees (90°) relative to the alternating current in each adjacent said coil.

13. A device as recited in claim 12 further comprising a first plurality of electrodes at said first end and a second plurality of electrodes at said second end.

14. A device as recited in claim 13 further comprising a means for connecting said electrodes to ground with at least one resistor interconnected between said electrodes and ground to allow the electric field (E) to charge up and wherein said first plurality of electrodes include a plurality of passive ring electrodes concentrically mounted at said first end of said chamber and said second plurality of electrodes include a plurality of passive ring electrodes concentrically mounted at said second end of said chamber.

15. A device as recited in claim 9 wherein the plasma is introduced into said chamber through said first end thereof and said device further comprises a collector at said second end of said chamber for collecting the particles $M_2$ and wherein the particles $M_1$ are collected on said wall of said cylinder.

16. A method for separating particles of relatively high mass/charge ratios ($M_1$) from particles of relatively low mass/charge ratios ($M_2$) which comprises the steps of:

rotating a magnetic field about an axis;

introducing a multi-species plasma containing particles $M_1$ and particles $M_2$ into the rotating magnetic field to rotate the multi-species plasma; and establishing a substantially axially aligned magnetic field for interaction with said rotating multi-species plasma to induce a radially oriented electric field and separate the particles $M_1$ from the particles $M_2$ in the axially aligned magnetic field and radially oriented electric field.

17. A method as recited in claim 16 further comprising the step of providing a cylinder having a first end and a second end with a wall extending therebetween to define a chamber around the axis for holding the plasma during interaction of the plasma with the electric and magnetic fields.

18. A method as recited in claim 17 wherein said rotating step is accomplished using four substantially rectangular shaped coils mounted on said wall of said cylinder with each coil having a pair of opposed sides oriented substantially longitudinally, and a pair of opposed sides oriented substantially azimuthally relative to the axis.

19. A method as recited in claim 18 further comprising the step of sending an electrical current through respective said coils wherein the current in each said coil is an alternating current with the alternating current in each said coil having a phase difference of ninety degrees (90°) relative to the alternating current in each adjacent said coil to accomplish said rotating and said establishing steps.

20. A method as recited in claim 19 further comprising the steps of:

mounting at least one electrode at a said end of said wall for interaction with the plasma;

electrically connecting said electrode to a resistor; and electrically connecting said resistor to ground.

* * * * *

UNITED STATES PATENT AND TRADEMARK OFFICE

CERTIFICATE OF CORRECTION

PATENT NO. : 6,797,176 B1 
DATED : September 28, 2004
INVENTOR(S) : Tihiro Ohkawa It is certified that error appears in the above-identified patent and that said Letters Patent is hereby corrected as shown below:

Column 2,
Line 49, delete "$E_z = i\,\theta\,A_z$" insert -- $E_z = i\,\omega\,A_z$ --
Line 59, delete "$\{r^{-1}\,\partial / \partial r[\,r\,\partial / \partial r]-r^2 / r^2 + i\,\mu_0\,\sigma\,[\omega - l\,\omega_0]\,\}\,A_z = 0$"
insert -- $\{r^{-1}\,\partial/\partial r\,[\,r\,\partial / \partial r]\,-l^2 / r^2 + i\,\mu_0\,\sigma\,[\,\omega - l\,\omega_0\,]\,\}\,A_z = 0$ --

Column 3,
Line 5, delete "$F_\theta = [½]\,j_z{}^*B_r = [\sigma\,\omega'\,l / 2\,r]A^*A\,J_r[k^*r]J_r[kr]$"
insert -- $F_\theta = [½]\,j_z{}^*\,B_r = [\,\sigma\,\omega'\,l\,/2\,r]\,A^*A\,J_l[k^*r]J_l[kr]$ --
Line 10, delete "$F_\theta = [\,\mu_0\,\sigma\,\omega'\,r\,/1\,]\,[B_r{}^*\,B_r/2\,\mu_0]$"
insert -- $F_\theta = [\mu_0\,\sigma\,\omega'\,r\,/\,l]\,[B_r{}^*\,B_r\,/2\,\mu_0]$ --
Line 38, delete "1" insert -- $l$ --
Line 39, delete "l-1" insert -- $l$-1 --

Signed and Sealed this

Eighteenth Day of January, 2005

JON W. DUDAS
*Director of the United States Patent and Trademark Office*